US006615593B2

(12) United States Patent
Thurman

(10) Patent No.: US 6,615,593 B2
(45) Date of Patent: Sep. 9, 2003

(54) METHODS OF REDUCING ENERGY AND MAINTENANCE COSTS ASSOCIATED WITH A REFRIGERATION SYSTEM

(76) Inventor: Matt Alvin Thurman, 10350 Lehman Rd., Orlando, FL (US) 32825

( * ) Notice: Subject to any disclaimer, the term of this patent is extended or adjusted under 35 U.S.C. 154(b) by 0 days.

(21) Appl. No.: 10/062,295

(22) Filed: Jan. 31, 2002

(65) Prior Publication Data

US 2003/0084676 A1 May 8, 2003

Related U.S. Application Data

(60) Provisional application No. 60/335,182, filed on Nov. 2, 2001.

(51) Int. Cl.[7] ..... F25D 2/14; F25D 17/06; A47F 3/04

(52) U.S. Cl. ..... 62/89; 62/285; 62/256

(58) Field of Search ..... 62/89, 256, 285

(56) References Cited

U.S. PATENT DOCUMENTS

| | | | | | |
|---|---|---|---|---|---|
| 2,914,927 | A | | 12/1959 | Corhandis | 62/429 |
| 3,415,073 | A | | 12/1968 | Ammons | 62/259 |
| 3,421,338 | A | | 1/1969 | Gidseg | 62/155 |
| 3,486,347 | A | | 12/1969 | Gidseg | 62/155 |
| 3,499,295 | A | * | 3/1970 | Brennan | 62/246 |
| 3,501,925 | A | * | 3/1970 | Brennan et al. | 62/256 |
| 3,675,440 | A | * | 7/1972 | Ibrahim | 62/256 |
| 3,698,205 | A | * | 10/1972 | Perez | 62/256 |
| 3,712,078 | A | | 1/1973 | Maynard et al. | 62/448 |
| 3,747,504 | A | * | 7/1973 | Turko et al. | 454/59 |
| 4,208,884 | A | | 6/1980 | Popham | 62/282 |
| 4,267,706 | A | * | 5/1981 | Abraham | 62/256 |
| 4,269,037 | A | * | 5/1981 | Karashima | 62/256 |
| 4,301,663 | A | * | 11/1981 | Hoshino | 62/453 |
| 4,304,101 | A | | 12/1981 | Gidseg | 62/187 |
| 4,375,155 | A | * | 3/1983 | Rosanio et al. | 62/256 |
| 4,467,618 | A | | 8/1984 | Gidseg | 62/187 |
| 4,638,644 | A | | 1/1987 | Gidseg | 62/329 |
| 4,776,182 | A | | 10/1988 | Gidseg | 62/448 |
| 4,920,764 | A | | 5/1990 | Martin | 62/259 |
| 5,086,627 | A | | 2/1992 | Borgen | 62/229 |
| 5,491,980 | A | | 2/1996 | Yingst et al. | 62/237 |
| D373,775 | S | * | 9/1996 | Andrade | 62/246 |
| 5,622,059 | A | * | 4/1997 | McClellan | 62/448 |
| 5,655,595 | A | | 8/1997 | Westbrooks, Jr. | 165/48.1 |
| 5,953,929 | A | | 9/1999 | Bauman et al. | 62/259.1 |
| D427,211 | S | * | 6/2000 | Piterski et al. | 62/246 |
| 6,070,424 | A | | 6/2000 | Bauman et al. | 62/279 |
| 6,301,913 | B1 | * | 10/2001 | Schulak et al. | 62/248 |

* cited by examiner

*Primary Examiner*—William E. Tapolcai
*Assistant Examiner*—Mohammad M. Ali
(74) *Attorney, Agent, or Firm*—Allen, Dyer, Doppelt, Milbrath & Gilchrist, P.A.

(57) ABSTRACT

A method of reducing energy costs and reducing maintenance costs for a refrigeration system are provided. More particularly, the method or reducing energy costs preferably includes connecting an evaporator to a top outer surface of a refrigeration container and forming a cool air curtain by removing warm air from an interior upper portion of the refrigeration container and introducing cool air into the interior upper portion of the refrigeration container. The method of reducing maintenance costs preferably includes connecting an evaporator to an outer surface of a refrigeration container and providing ready access to the evaporator so that maintenance can be readily conducted on the evaporator.

9 Claims, 10 Drawing Sheets

METHODS OF REDUCING ENERGY AND MAINTENANCE COSTS ASSOCIATED WITH A REFRIGERATION SYSTEM

RELATED APPLICATIONS

The present application claims the benefit of Provisional Patent Application Serial No. 60/335,182, filed on Nov. 2, 2001 and titled REFRIGERATION AIR HANDLING APPARATUS AND ASSOCIATED METHODS. The present application is related to patent application Ser. No. 10/062,575, titled Methods of Reducing Energy and Maintenance Costs Associated with a Refrigeration System filed on the same date herewith by the same inventor and which is incorporated herein in its entirety by reference.

FIELD OF THE INVENTION

The present invention relates to the refrigeration industry and more particularly, to the field of energy and maintenance efficiency of refrigeration systems.

BACKGROUND OF THE INVENTION

In a commercial refrigeration apparatus, an evaporator is generally positioned within an interior region of a refrigeration container. For example, in a refrigeration apparatus positioned within a grocery store, e.g., a refrigeration display case having a glass door or an open refrigeration display case having no door, the evaporator is generally positioned along a bottom inner periphery of the refrigeration container. Applicant has recognized that this configuration tends to create numerous maintenance problems such as evaporator accessibility and clogging of drain lines, especially during transitions from defrost cycles. The evaporator positioned within the refrigeration container typically includes intake and output ducts. The configuration of the intake and output ducts, however, also cause maintenance problems in that they become easily clogged with various items that fall to the bottom of the refrigeration container, e.g., price tags and bits of food, during these cycles. Clogged intake and output ducts significantly decrease the efficiency of the refrigeration system.

In the case of walk-in refrigeration units, the evaporator is generally suspended from a top inner periphery of the refrigeration container. Applicant has recognized that condensation from the evaporator generally tends to accumulate especially during frost cycles, presenting various problems including potential health hazards. Another problem that exists with a walk-in refrigeration apparatus having an evaporator suspended from a top inner periphery of the refrigeration container is electrical maintenance. Electrical wiring to and from such evaporators are positioned within the refrigeration container closely adjacent a great deal of condensation which can occur during defrost cycles which often occur three to six times per day, for example, in commercial refrigeration units. The condensation can sometimes cause shorts and other electrical malfunctions, raising another potential hazard. Still another problem that exists with the walk-in refrigeration units is cleanliness and sanitation, i.e., condensation changes from defrost cycles from the suspended evaporators tends to drip onto food and other consumable items stored in the walk-in refrigeration container, causing a serious health risk.

Applicant has also recognized that another problem that commonly exists in a refrigeration apparatus having an evaporator positioned within the refrigeration container is that drain lines tend to freeze when positioned within the refrigeration container. When the condensed liquid in the drain lines freezes, it tends to expand and the drain lines can therefore sometimes burst.

Positioning components of a refrigeration apparatus exterior a refrigeration container is known as can be seen in U.S. Pat. No. 6,070,424 to Bauman et al. titled *Modular Refrigeration Unit*. Applicant has recognized, however, that the configuration of a condenser and evaporator positioned closely adjacent one another is highly inefficient and is not well suited for commercial applications, such as refrigeration systems for grocery stores. A more energy efficient and low maintenance refrigeration system is still needed.

SUMMARY OF THE INVENTION

With the foregoing in mind, the present invention advantageously provides a more efficient refrigeration system and apparatus, a more efficient evaporator apparatus, a refrigeration apparatus conversion kit for converting existing refrigeration apparatuses into more energy and cost efficient refrigeration apparatuses, and associated methods that greatly reduces maintenance needs, enhance energy efficiency, especially during defrost cycles, and reduce various hazards associated with existing refrigeration systems and apparatuses. For example, because an evaporator is removed from the interior of a refrigeration container and placed at a location exterior to and preferably on top of the refrigeration container, significantly less energy is required to defrost or heat the evaporator for the refrigeration container. Because the evaporator is positioned outside of the refrigeration container and preferably in an insulated housing on top of the refrigeration container, less area of the evaporator to heat is required for defrost cycles which can occur about 3–6 times per day, the evaporator then uses much less energy to defrost. Accordingly, for grocery stores or other structures which contain numerous evaporators for refrigeration containers, the energy saving during defrost cycles can be tremendous. The refrigeration system and apparatus of the present invention advantageously identifies the source of the problems associated with sanitation and cleanliness within a refrigeration container, and solves this problem by connecting an evaporator to exterior portions of a refrigeration container. The present invention also advantageously identifies and solves the problem of cleanliness and sanitation with existing refrigeration containers by removing collected condensate from the refrigeration system before it can be introduced to an interior portion of the refrigeration container. By positioning an evaporator on top of a refrigeration container, the difference between discharge air temperature of the cooled air from the evaporator and the ambient inside air temperature of the refrigeration container greatly reduces the accumulation of condensation on exterior surfaces, e.g., bottom, back, or side walls, of the refrigeration container such as a refrigerated display case.

More specifically, the present invention preferably includes a method of reducing energy costs associated with a refrigeration system. The method preferably includes connecting an evaporator to a top outer surface of a refrigeration container so that the evaporator overlies the top outer surface of the refrigeration container, and forming a cool air curtain by removing warm air from an interior upper portion of the refrigeration container and introducing cool air into the interior upper portion of the refrigeration container. The present invention also advantageously includes a method of reducing maintenance costs of a refrigeration system positioned in a grocery store building. The method preferably includes connecting an evaporator to an outer surface of a refrigeration container so that maintenance can be performed on the evaporator without accessing interior portions of the refrigeration container, and providing ready access to the evaporator so that maintenance can be readily conducted on the evaporator unit. The present invention further preferably includes a method of reducing maintenance costs associated with a drain line to remove condensate from an evaporator of a refrigeration apparatus. The method preferably includes positioning a drain pan to underlie an evaporator positioned exterior a refrigeration container to collect the condensate from the evaporator, and connecting a drain line to the drain pan positioned exterior the refrigeration container so that the drain line is positioned exterior the refrigeration container and so that the condensate is removed from the drain pan without freezing.

The present invention advantageously decreases maintenance costs associated with refrigeration system by preventing drain lines from freezing and by eliminating clogs in an evaporator by removing the evaporator from an environment that is quite prone to clogging. The present invention further advantageously enhances the efficiency of an evaporator and greatly reduces the cost of operating and maintaining a refrigeration air handling apparatus.

BRIEF DESCRIPTION OF THE DRAWINGS

Some of the features, advantages, and benefits of the present invention having been stated, others will become apparent as the description proceeds when taken in conjunction with the accompanying drawings in which.

DETAILED DESCRIPTION OF THE PREFERRED EMBODIMENTS

Figure 1:
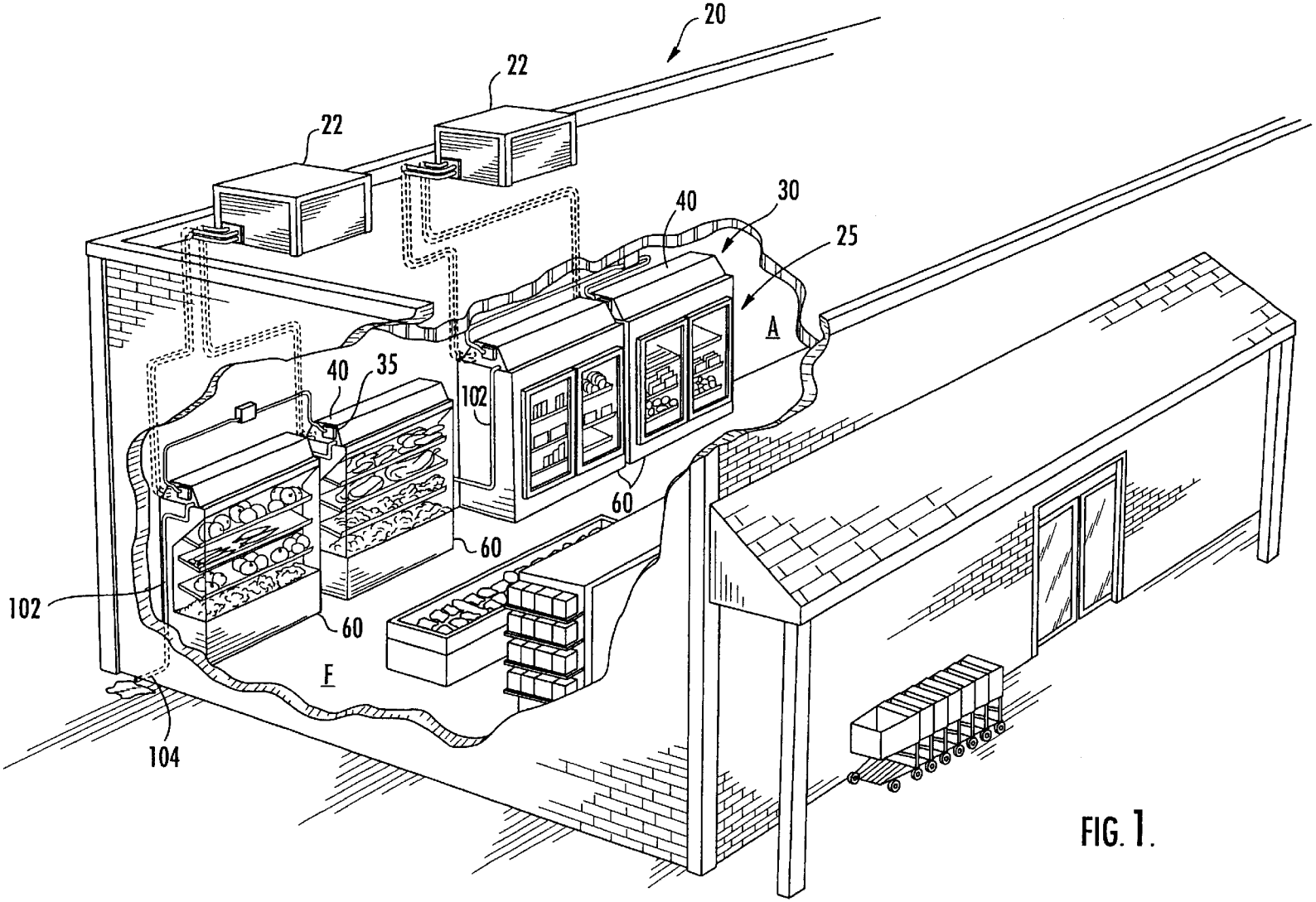
FIG. 1 is an environmental view of a refrigeration system having portions of a grocery store building broken away to show a plurality of refrigeration apparatuses positioned within a predetermined area according to the present invention.

The present invention will now be described more fully hereinafter with reference to the accompanying drawings which illustrate preferred embodiments of the invention. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, the prime, double prime, or triple prime notation, if used, indicates similar elements in alternative embodiments.

As illustrated in FIGS. 1–13, the present invention advantageously provides a refrigeration system 20, a refrigeration apparatus 25, an evaporator apparatus 30, a refrigeration apparatus conversion kit 90, and associated methods. More specifically, as perhaps best illustrated in FIG. 1, the present invention includes a refrigeration system 20 which preferably includes a plurality of refrigeration apparatuses 25 positioned within a predetermined area A and a plurality of condensers 22 positioned exterior the predetermined area A. The predetermined area A can, for example, advantageously be defined as a grocery store, e.g., a supermarket or a convenience store, or a "super center", e.g., a combination retail outlet and grocery store.

Figure 2:
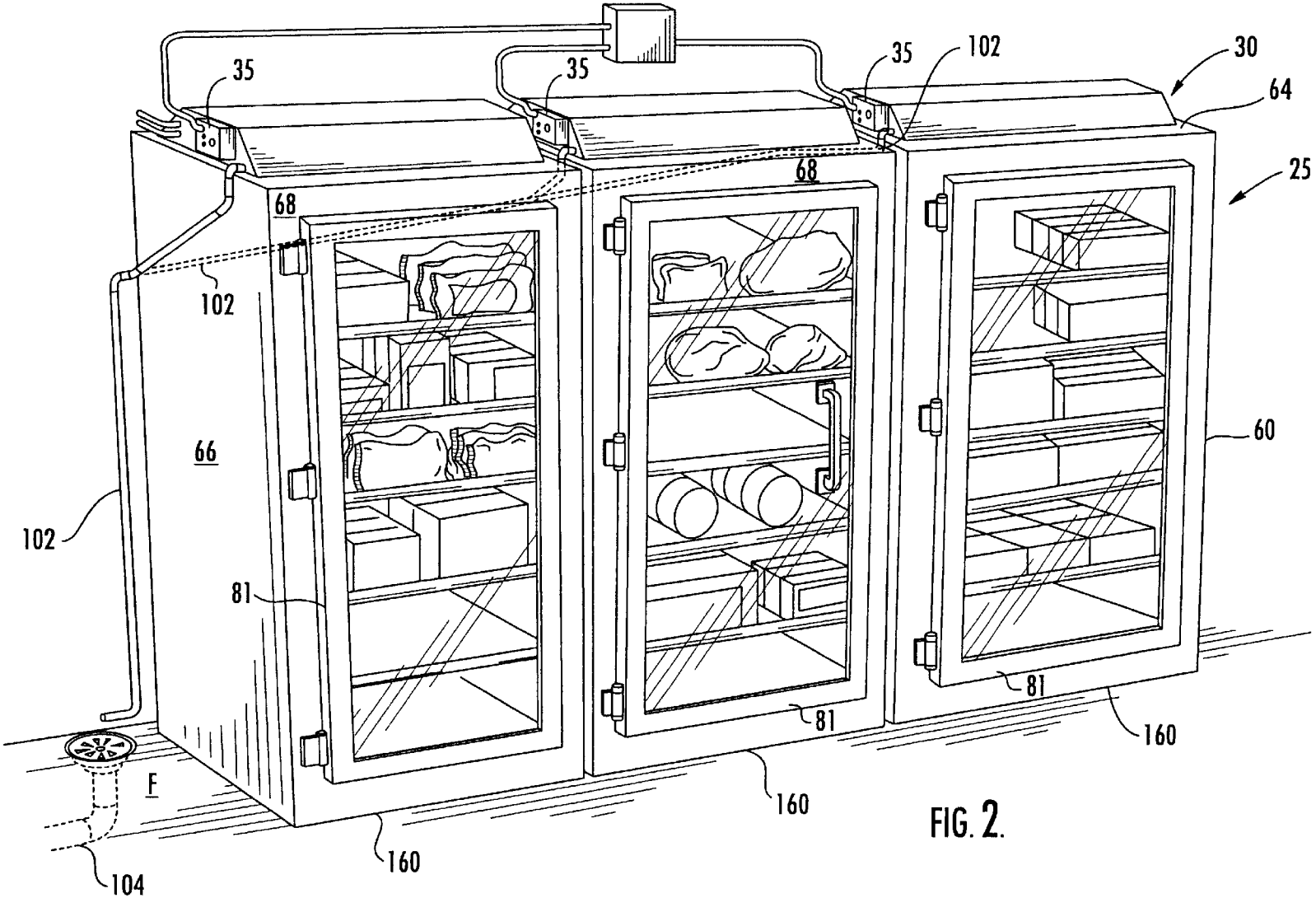
FIG. 2 is a perspective view of a plurality of refrigeration apparatuses according to the present invention.
Figure 3:
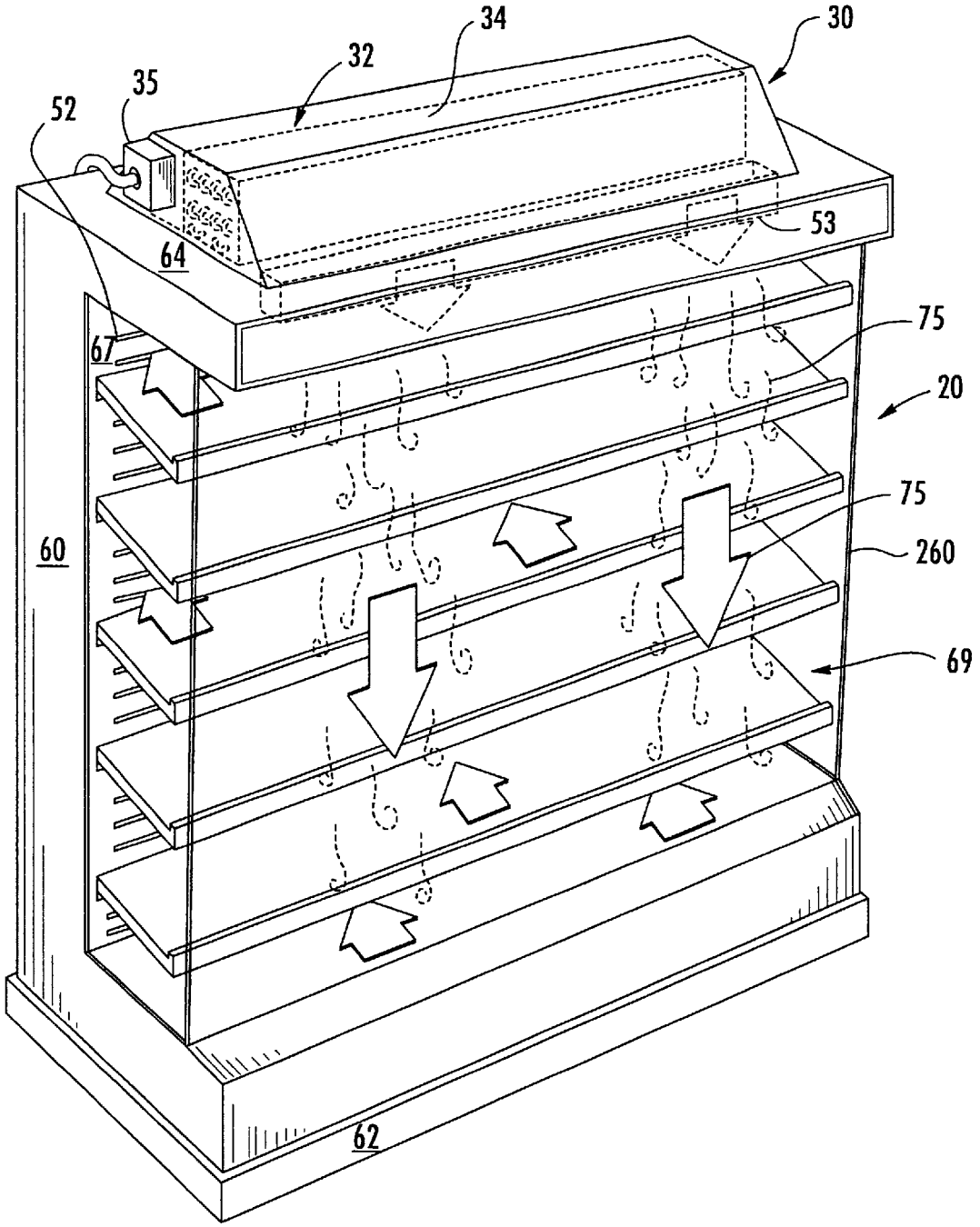
FIG. 3 is a perspective view of a refrigeration apparatus having an open display refrigeration container according to another embodiment of the present invention.
Figure 4:
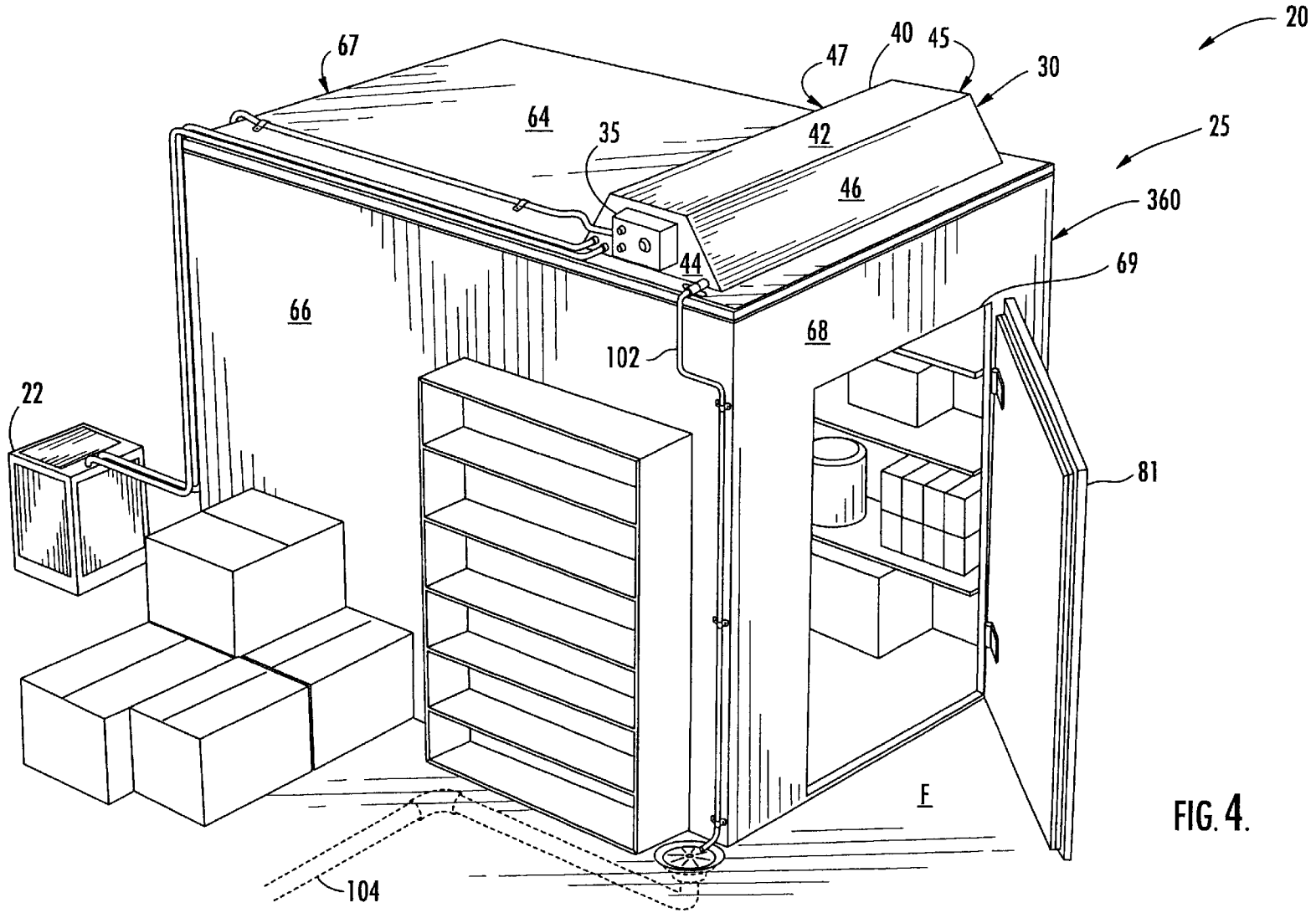
FIG. 4 is a perspective view of a refrigeration apparatus having a walk-in refrigeration container according to yet another embodiment of the present invention.
Figure 6:
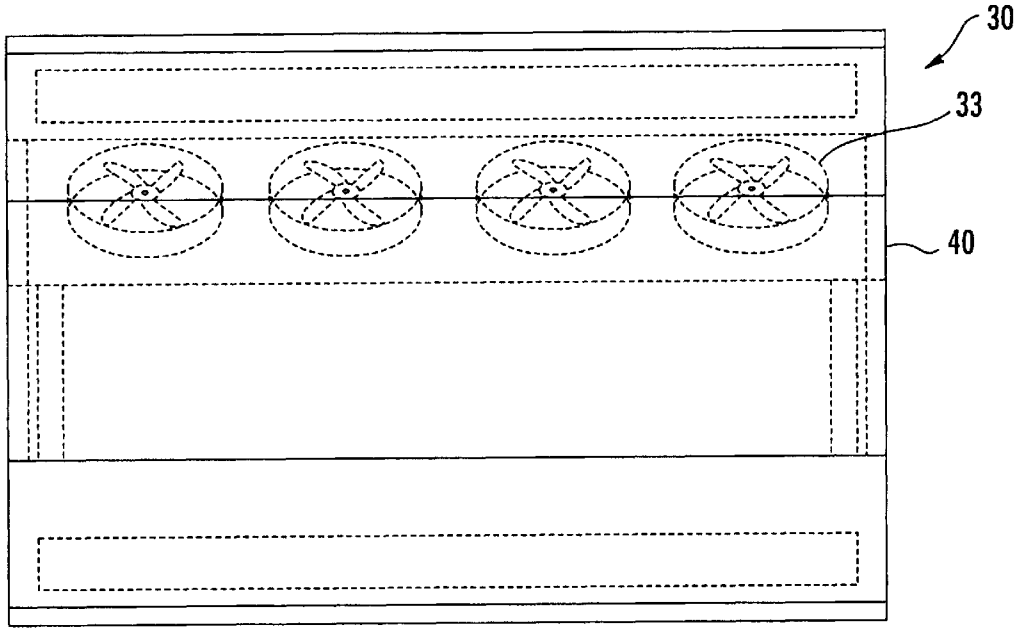
FIG. 6 is a top plan view of an evaporator of a refrigeration apparatus according to the present invention.
Figure 7:
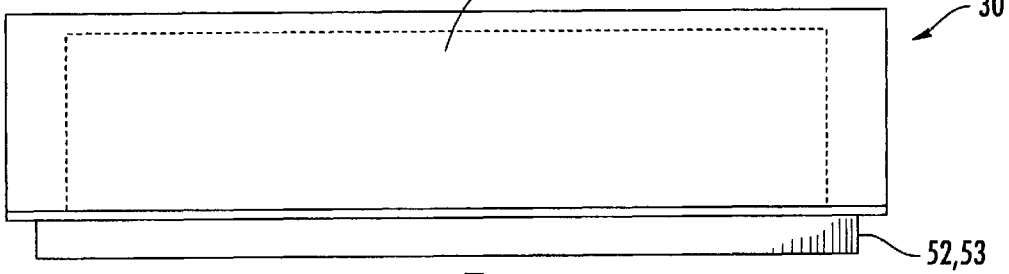
FIG. 7 is a front plan view of an evaporator of a refrigeration apparatus according to the present invention.

As perhaps best illustrated in FIGS. 2–4, the refrigeration apparatus 25 of the present invention and of the refrigeration system 20 preferably include at least one refrigeration container 60. As best illustrated in FIG. 2, the refrigeration system 20 of the present invention preferably includes a plurality of refrigeration containers 60 positioned within the predetermined area A. Each of the refrigeration containers 60 preferably has a bottom 62, a top 64 positioned spaced-apart from and overlying the bottom 62, a plurality of sidewalls 66 positioned to extend between the bottom 62 and the top 64, a rear wall 67 extending between the bottom 62 and the top 64 adjacent the sidewalls 66 and a front wall 68 extending between the bottom 62 and the top 64 adjacent the sidewalls 66. The front wall 68 preferably includes a front access opening 69 positioned opposite the rear wall 67. The top of each of the refrigeration containers 64 preferably includes an intake opening 70 and an output opening 71 formed therein. Each of the openings are preferably substantially rectangular in shape and extend a predetermined length along the top of the refrigeration container 64. The intake opening 70 is preferably positioned adjacent the rear wall of the refrigeration container 67 and the output opening 71 is preferably positioned substantially opposite the intake opening 70 and adjacent the front wall of the refrigeration container 68.

As perhaps best illustrated in FIG. 2, in a first embodiment, the refrigeration container 60 can be provided by a closed display refrigeration container 160 having a door 81 that is substantially transparent associated with the front wall 68 and covering the front access opening 69. Again, the door 81 can be positioned between an open and a closed position. A user positioned exterior the refrigeration container 160 can readily view interior portions of the refrigeration container 160 when the door 81 is in a closed position. When the door 81 is in the open position, however, the user is advantageously provided ready access to the interior portions of the refrigeration container 160 through the front access opening 69.

As perhaps best illustrated in FIG. 3, in a second embodiment the refrigeration container 60 can further be provided by an open display refrigeration container 260 devoid of a door 81 covering the front access opening 69. The open display refrigeration container 260, therefore, provides ready access to users of interior portions of the refrigeration container 260.

As best illustrated in FIG. 4, in a third embodiment, the refrigeration container 60 can be provided by a walk-in refrigeration container 360 having a door 81 associated with the front wall 68 and substantially covering the front access opening 69. The door 81 preferably includes an open and a closed position. When the door 81 is in the closed position, the front access opening 69 of the refrigeration container 360 is preferably covered. A user is provided ready access to interior portions of the refrigeration container 360 when the door is positioned in the open position. More specifically, in a walk-in type refrigeration container, a user can advantageously enter interior portions of the refrigeration container when the door 81 is positioned in the open position.

The bottom 62, top 64, and plurality of sidewalls 66 of the refrigeration containers are preferably thermally insulated. For example, the bottom 62, top 64, and plurality of sidewalls 66 can include an inner and an outer layer. The inner layer is preferably provided by a thermal insulating material. The thermal insulating material can advantageously be provided by urethane material, for example, a foam material, or any other type of insulating material that has high thermal insulation properties. The outer layer of the bottom 62, top 64, and plurality of sidewalls 66 is preferably positioned to overlie the inner layer and can be provided by aluminum material, for example, or any other type of material that preferably includes high strength, light weight, and high flexibility properties.

As perhaps best illustrated in FIGS. 2–4, the refrigeration system 20 and the refrigeration apparatus 25 of the present invention preferably includes at least one evaporator apparatus 30 positioned to overlie the refrigeration container 60. More specifically, and as best illustrated in FIG. 1, the refrigeration system 20 of the present invention preferably includes a plurality of evaporator apparatuses 30 positioned within the predetermined area A so that one evaporator apparatus 30 overlies one refrigeration container 60. More particularly, and as best illustrated in FIGS. 6–9, the evaporator apparatus 30 preferably includes a thermally insulated housing 40. Each thermally insulated housing 40 preferably includes a bottom 41 and a top 42 positioned spaced-apart from and overlying the bottom 41. The bottom 41 preferably has a first predetermined width $W_1$ and the top 42 preferably has a second predetermined width $W_2$. The first predetermined width $W_1$ is preferably substantially longer than the second predetermined width $W_2$. The thermally insulated housing 40 also preferably includes a plurality of sidewalls 43 extending between the top 42 and the bottom 41.

Figure 9:
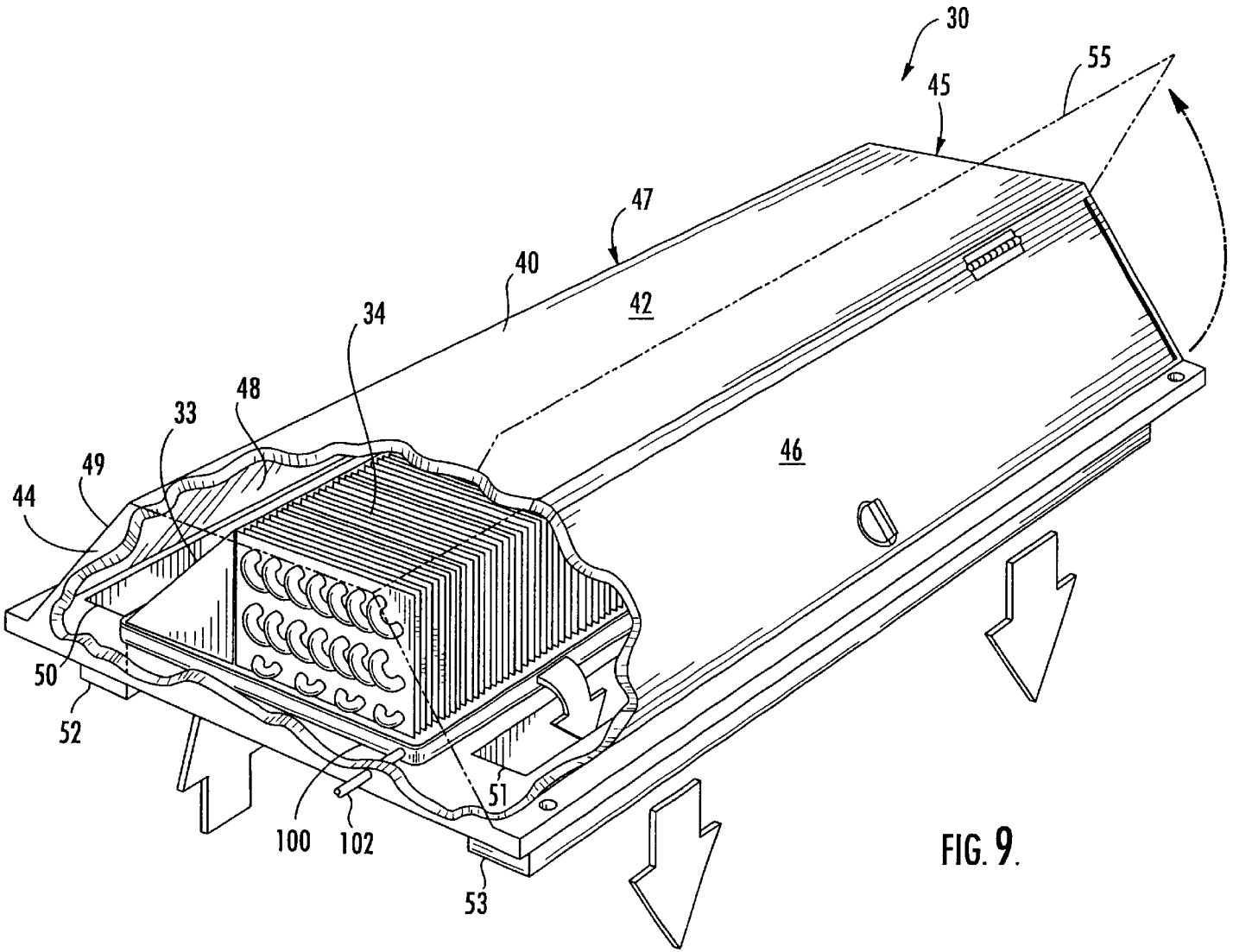
FIG. 9 is a fragmentary perspective view of an evaporator of a refrigeration apparatus according to the present invention.
Figure 10:
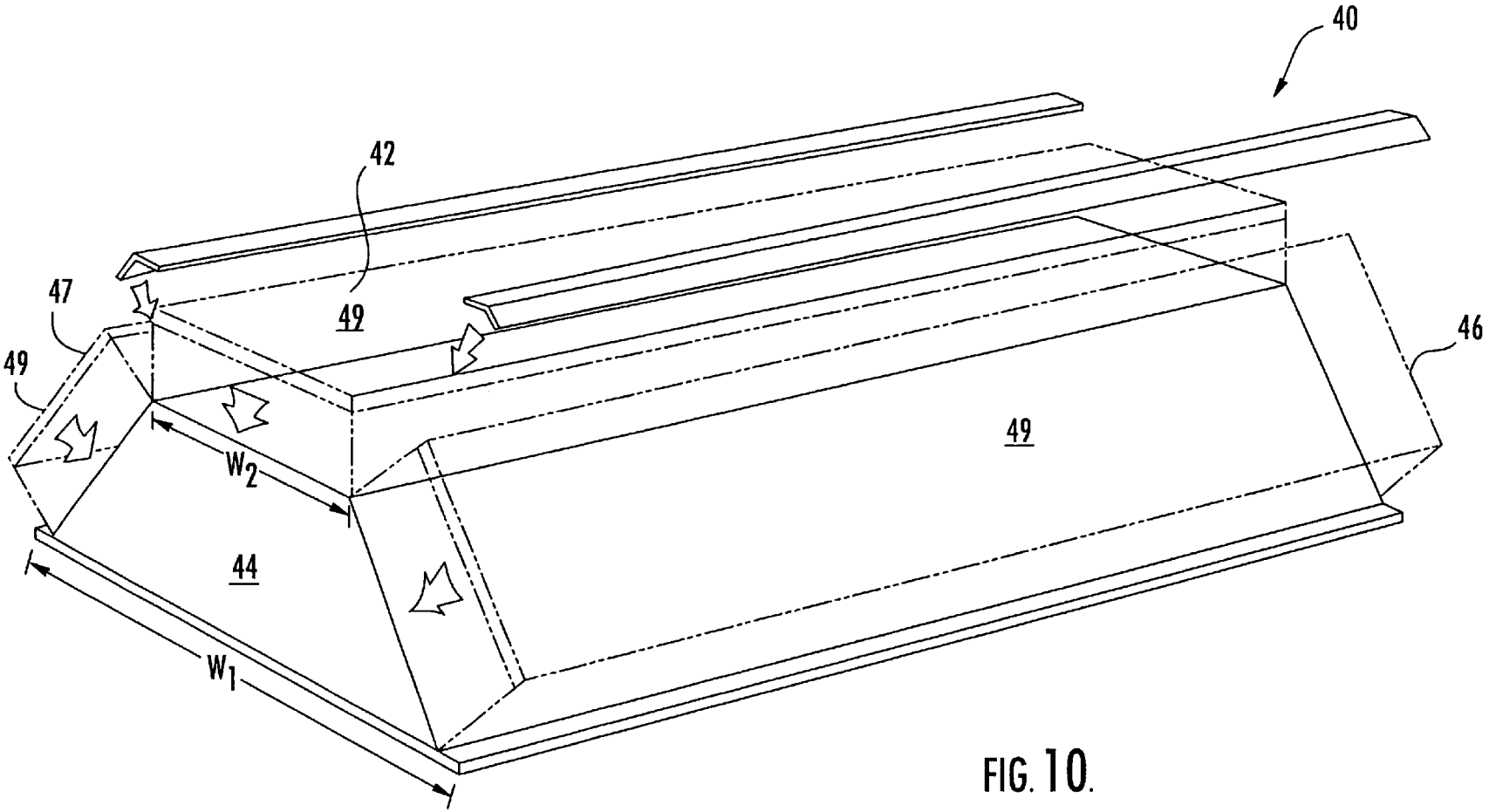
FIG. 10 is an exploded perspective view of an insulated housing of an evaporator of a refrigeration apparatus according to the present invention.

As perhaps best illustrated in FIG. 9, the bottom 41, top 42, and plurality of sidewalls 43 of each of the plurality of thermally insulated housings 40 in the refrigeration system 20, the refrigeration apparatus 25, and the evaporator apparatus 30 further preferably includes an inner layer 48 and an outer layer 49 positioned to overlie the inner layer 48. The inner layer 48 is preferably defined as an inner thermal insulating layer and the outer layer 49 is preferably defined as an outer shell layer. The outer shell layer is preferably provided by aluminum, or any other type of material having high strength, light weight, and low deformation properties. The inner thermal layer is preferably provided by urethane material, or any other type of material that has thermal insulating properties. The inner thermally layer can, for example, be adhesively applied to one side of the outer shell layer. The side of the outer shell layer having the thermal insulating material applied thereto then defines the inner portion of the outer shell layer.

The plurality of sidewalls 43 of the thermally insulated housing 40 are preferably defined by a first sidewall 44 and a second sidewall 45 positioned spaced-apart from and substantially opposite to the first sidewall 44. The plurality of sidewalls 43 also preferably include a front sidewall 46 and a rear sidewall 47 positioned spaced-apart from and substantially opposite the front sidewall 46. The front and rear sidewalls 46, 47 are preferably positioned adjacent the first and second sidewalls 44, 45.

Each of the thermally insulated housings 40 also preferably include an intake 50 and an output 51 positioned so that the intake 50 overlies the intake opening 70 formed in the top of the refrigeration container 60 and the output 51 overlies the output opening 71 formed in the top of the refrigeration container 60. Each of the thermally insulated housings 40 also preferably includes an access door 55 positioned adjacent one of the sidewalls 43 so that the a user can advantageously readily access the evaporator 32 positioned within the thermally insulated housing 40 to perform maintenance. The door 55 is preferably connected to the top of the insulated housing 42 by a hinge connection so that the door 55 swings upwardly to thereby provide access to the evaporator 32 positioned within the insulated housing 40.

The refrigeration system 20, the refrigeration apparatus 25, and the evaporator apparatus 30 preferably include an evaporator 32 positioned within the insulated housing 40. More particularly, and as perhaps best illustrated in FIG. 1, the refrigeration system 20 preferably includes a plurality of evaporators 32 each positioned within the predetermined area A so that one evaporator 32 is positioned within one thermally insulated housing 40. The evaporator 32 is preferably positioned between the intake 50 and the output 51 of the thermally insulated housing 40. The evaporator 32 also preferably includes a plurality of fans 33 positioned at a predetermined angle adjacent the intake 50, and a cooling coil 34 positioned closely adjacent the plurality of fans 33. More particularly, the plurality of fans 33 preferably extend at an angle from the bottom of the insulated housing 40 between about 30 and 60 degrees, as best illustrated in FIG. 9. The predetermined angle advantageously allows the plurality of fans 33 to efficiently move air from within the refrigeration container 60 and through the evaporator 32.

The plurality of fans 33 preferably extend substantially the length of the cooling coil 34 to move air having a first predetermined temperature, e.g., warm air, from within the refrigeration container 60, through the intake opening of the refrigeration container 70, into the intake of the insulated housing 50, over the cooling coil 34, to the output of the insulated housing 51 through the output opening of the refrigeration container 71, and into the refrigeration container 60 as air having a second predetermined temperature, e.g., cool air. Therefore, the first predetermined temperature is substantially higher than the second predetermined temperature and the air having the first predetermined temperature that passes through the cooling coil 34 is then defined as the air having the second predetermined temperature.

Figure 5:
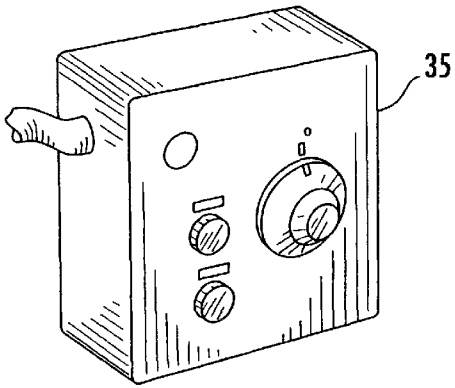
FIG. 5 is a fragmentary perspective view of a controller for a refrigeration apparatus according to the present invention.
Figure 8:
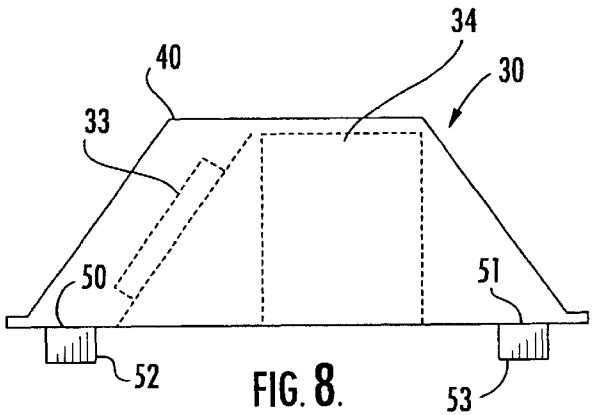
FIG. 8 is a side elevational view of an evaporator of a refrigeration apparatus according to the present invention.

As perhaps best illustrated in FIG. 5, the refrigeration system 20, refrigeration apparatus 25, and the evaporator apparatus 30 preferably include a controller 35 connected to a sidewall 43 of the insulated housing 40. The controller 35 is preferably adapted to control the temperature setting of the refrigeration apparatus 25 and is advantageously positioned so that a user can readily access it to change the temperature of the cool air introduced into the refrigeration container 60.

As best illustrated in FIG. 3, the cool air flowing downwardly from the output opening of the refrigeration container 71 preferably defines a cool air curtain 75 adjacent the front wall of the refrigeration container 68 instead of a directed blow or blast of cool air through a small opening. The cool air curtain 75 is especially advantageous in open display refrigeration containers 84, e.g., refrigeration containers devoid of a front door, as illustrated in FIG. 3, in that the cool air curtain 75 distributes the cool air more evenly, forms a barrier to keep cool air from escaping into the surrounding environment, and reduces damage to the refrigeration container and food positioned therein. The cool air curtain 75 prevents warm air from the surrounding environment from entering the refrigeration container 60 and, therefore, makes the refrigeration apparatus 25 and refrigeration system 20 more efficient than conventional refrigeration systems that are not adapted to form a cool air curtain 75. If the cool air curtain 75 is pierced, by a customer reaching into the refrigeration container 60 to readily access products positioned therein for example, then cool air flowing into the refrigeration container 60 from the top inner portion of the refrigeration container 60 advantageously fills the void to thereby form a completed cool air curtain 75 once again.

As best illustrated in FIG. 1, the refrigeration system 20 further preferably includes a plurality condensers 22 positioned exterior the predetermined area A, e.g., on a roof top of a grocery store building, or in a separate room within a grocery store building. The plurality of condensers 22 are preferably connected to the plurality of evaporators 32 positioned within the predetermined area A so that a cooling gas positioned within each of the plurality of condensers 22 is condensed into a cooling liquid that is passed through the cooling coil 34 in each of the evaporators 32. In colder climates, condensers 22 that are positioned exterior the grocery store building may need to be positioned within a separate enclosure to be protected from environmental effects.

The refrigeration system 20, refrigeration apparatus 25, and evaporator apparatus 30 of the present invention further preferably include a drain pan 100. More specifically, the refrigeration system 20 preferably includes a plurality of drain pans 100 positioned within the predetermined area A so that a respective one of each of the plurality of drain pans 100 underlies a respective one of the plurality of evaporators 32 positioned within the insulated housings 40. The drain pan 100 is preferably positioned to collect condensate from the evaporator 32. The condensate forms on the evaporator 32 due to the temperature difference between the cooling coils 34 and the surrounding environment. To prevent the condensate from coming into contact with interior portions of the refrigeration container 60, the drain pan 100 advantageously is positioned to collect the condensate before such contact may occur.

As perhaps best illustrated in FIGS. 1–2, 4, 9, and 12–13, the refrigeration system 20, the refrigeration apparatus 25, and the evaporator apparatus 30 of the present invention further preferably include a drain line 102 positioned to extend from the drain pan 100 to remove condensate from the drain pan 100. More specifically, the refrigeration system 20 preferably includes a common drain line 102 positioned within the predetermined area A so that common drain line 102 is positioned to extend from and connect to each of the plurality of drain lines 102 so that the condensate collected in each of the drain pans 100 is readily removed to a position exterior the predetermined area A. In the refrigeration system 20, the drain line 102 is preferably extended to a common drain line or pipe 104, e.g., polyvinyl chloride ("PVC") that is positioned to extend over a floor slab F of the predetermined area A, i.e., over the floor of the grocery store building. Both the drain line 102 and the common drain pipe 104 can advantageously be provided by PVC, copper, or any other type of material suitable to remove the condensate without eroding. The common drain pipe 104 preferably extends to a position outside the grocery store building so that the condensate is disposed of outside the grocery store building. The drain pipe 104 can, for example, be positioned to extend to a storm sewer so that the condensate can be disposed of in the storm sewer. The drain pipe 104 preferably includes a diameter that is substantially larger than the drain line 102 so that the ends of the plurality of drain lines 102 are positioned to discharge the condensate into the common or single drain pipe 104.

The thermally insulated housings 40 preferably also include a pair of ducts 52, 53 defined by an intake duct and an output duct. The pair of ducts 52, 53 are adapted to be positioned in the pair of openings formed in the top of the refrigeration container. More specifically, the intake duct 52 is preferably connected to the intake of the insulated housing 50 to extend through the intake opening formed in the top of the refrigeration container 70. The output duct 53 is preferably connected to the output of the insulated housing 51 to extend through the output opening formed in the top of the refrigeration container 71. The thermally insulated housings 40 further preferably include a diffuser 54 connected to the output duct 53 so that the air having the second predetermined temperature, e.g., cool air, flowing downwardly from the output opening 71 to define the cool air curtain 75 is introduced into the refrigeration container 60 at an increased rate. This advantageously provides a more uniform cool air curtain 75 to make the refrigeration system 20 and apparatus 25 more efficient.

The refrigeration system 20, refrigeration apparatus 25, and evaporator apparatus 30 of the present invention are advantageously energy and maintenance efficient. By removing the necessity of a drain line 102 positioned within the refrigeration container 60, the present invention eliminates any possibility of a drain line 102 positioned within the refrigeration container 60 being clogged. Similarly, by eliminating intake and output ducts 52, 53 from the lower interior portions of the refrigeration container 60, food and other debris, such as price tags for example, will no longer fall into the ducts causing clogs and the need for increased maintenance. Furthermore, by positioning the intake and output ducts 52, 53 towards the top inner portion of the refrigeration container 60, the refrigeration system 20, refrigeration apparatus 25 and the evaporator apparatus 30 are more energy efficient. For example, warm air has a substantially lower density than cooler air, as understood by those skilled in the art. Therefore, warm air in a confined space, such as a refrigeration container 60, tends to rise. In the present invention, air is extracted from the top inner portions of the refrigeration container 60, i.e., at a location where the warm air will naturally be. Therefore, the refrigeration system 20, refrigeration apparatus 25, and evaporator apparatus 30 are more efficient because unlike conventional refrigeration systems having an evaporator positioned along a lower portion of a refrigeration container and removing the coldest air in the refrigeration container and replacing it with cool air, the present invention advantageously removes the warmest air in the refrigeration container 60 and replaces it with cool air. A smaller fan motor can advantageously be used to move the air through the evaporator 32 and thereby provide a more energy efficient refrigeration system 20, refrigeration apparatus 25, and evaporator apparatus 30.

Figure 11:
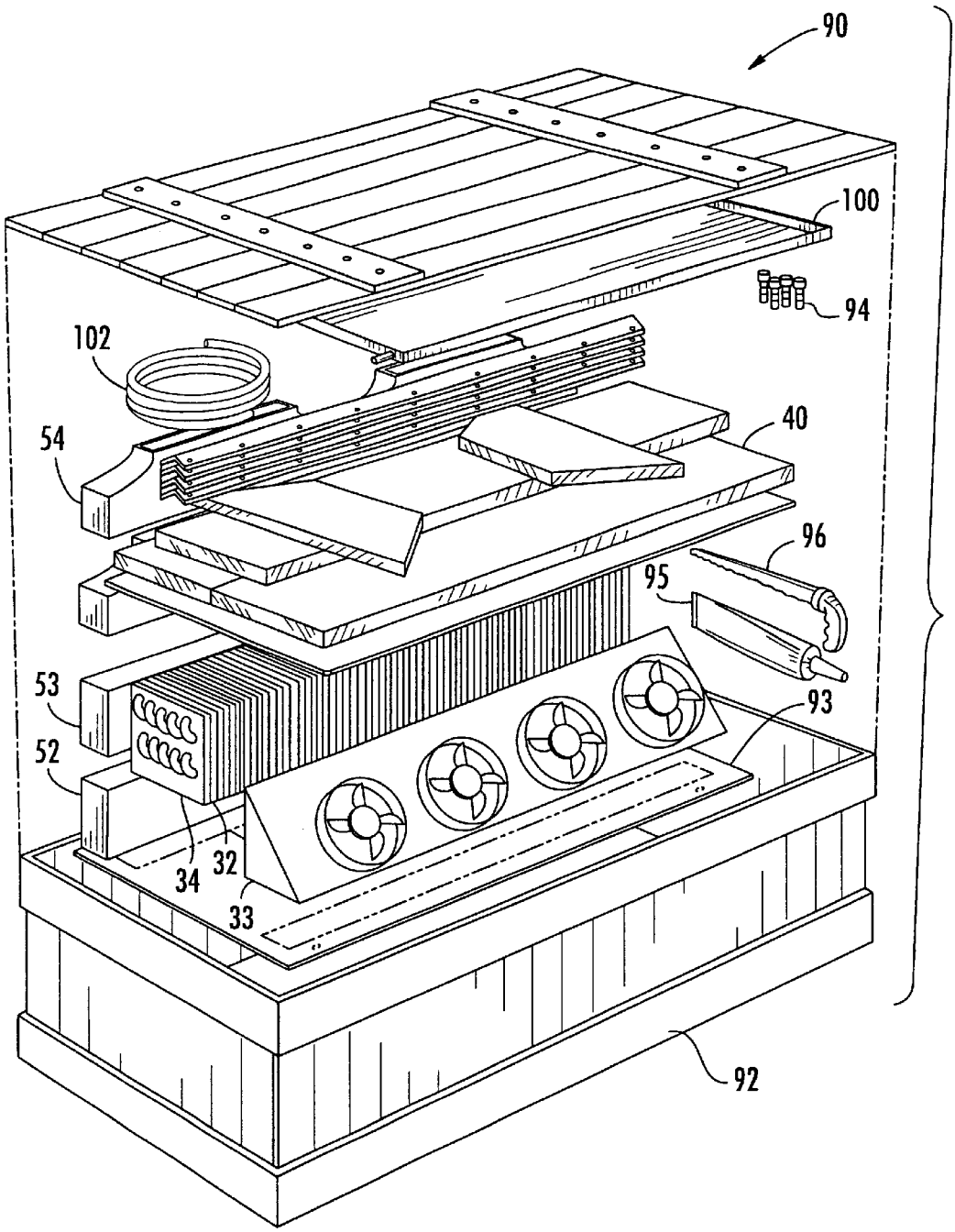
FIG. 11 is an exploded perspective view of a refrigeration apparatus conversion kit according to the present invention.

As best illustrated in FIG. 11, the present invention also preferably includes a refrigeration apparatus conversion kit 90 for converting a refrigeration apparatus having an evaporator positioned within a refrigeration container into a refrigeration apparatus 25 having an evaporator 32 positioned exterior the refrigeration container 60. The conversion kit 90 preferably includes a container 92 which can advantageously be provided by a wooden box, for example, or any other type of container suitable for transporting the refrigeration apparatus conversion kit 90. The kit 90 also preferably includes an evaporator 32 positioned within the container 92. The kit 90 also preferably includes a template 93 positioned within the container 92 to outline dimensions of a pair of openings to be formed in a top outer surface of the refrigeration container 60 and a pair of ducts 52, 53, e.g., duct, inserts, positioned within the container 90 to be inserted in the pair of openings 70, 71 formed in the top outer surface of the refrigeration container 60. The kit 90 further preferably includes a plurality of fasteners 94 positioned within the container 92 to fasten the evaporator 32 to the top outer surface of the refrigeration container 60. As best illustrated in FIG. 11, the plurality of fasteners 94, for example, can advantageously be provided by a plurality of bolts, screws, rivets, or any other type of fastener suitable to fasten the evaporator 32 to the refrigeration container 60. The kit 90 still further preferably includes a sealant 95 and/or sealing gasket positioned within the container 92 to seal a connection between the evaporator 32 and the refrigeration container 60. The use of the sealant 95 advantageously enhances the thermal insulation, thereby making the converted refrigeration apparatus more energy efficient.

The kit 90 also preferably includes a diffuser 54 positioned within the container 92 to be connected to the pair of duct inserts 52, 53 and a cutting tool 96 positioned within the container 92 to form the openings 70, 71 in the top outer surface of the refrigeration container 60. The kit 90 further preferably includes a drain pan 100 positioned within the container 92 to be positioned to underlie the evaporator 32 to collect condensate from the evaporator 32 and a drain line 34 positioned within the container 92 to be connected to the drain pan 100 to remove condensate collected in the drain pan 100. The kit 90 still further preferably includes a thermally insulated housing 40 positioned within the container 92 to surround the evaporator 32 when positioned to overlie the refrigeration container 60.

As perhaps best illustrated in FIGS. 2–4, the present invention also preferably includes a method of cooling air positioned in a grocery store refrigeration container 60. The method preferably includes extracting air having a first predetermined temperature from an upper portion of the grocery store refrigeration container 60, cooling the extracted air to a second predetermined temperature that is substantially lower than the first predetermined temperature, and introducing the air having the second predetermined temperature into the grocery store refrigeration container 60. The method also preferably includes collecting condensate from an evaporator 32 in a drain pan 100 to prevent the condensate from entering an interior portion of the grocery store refrigeration container 60 and draining the collected condensate from the drain pan 100 to a position spaced-apart from the grocery store refrigeration container 60.

The step of extracting the air having the first predetermined temperature preferably includes drawing low density warm air from a top portion of the grocery store refrigeration container 60 through an intake opening formed in the top portion of the grocery store refrigeration container 70 using a plurality of fans 33 positioned to overlie the grocery store refrigeration container 60. The step of cooling the extracted air preferably includes passing the extracted air over a cooling coil 34 to an output opening formed in the top portion of the grocery store refrigeration container 71.

The step of introducing the air having the second predetermined temperature into the grocery store refrigeration container 60 further preferably includes forming a cool air curtain 75 within a front portion of the grocery store refrigeration container 60 where the air having the second predetermined temperature is introduced. The step of forming the cool air curtain 75 further preferably includes introducing the air having the second predetermined temperature into the grocery store refrigeration container 60 spaced-apart from an area where the air having the first predetermined temperature is extracted.

Figure 12:
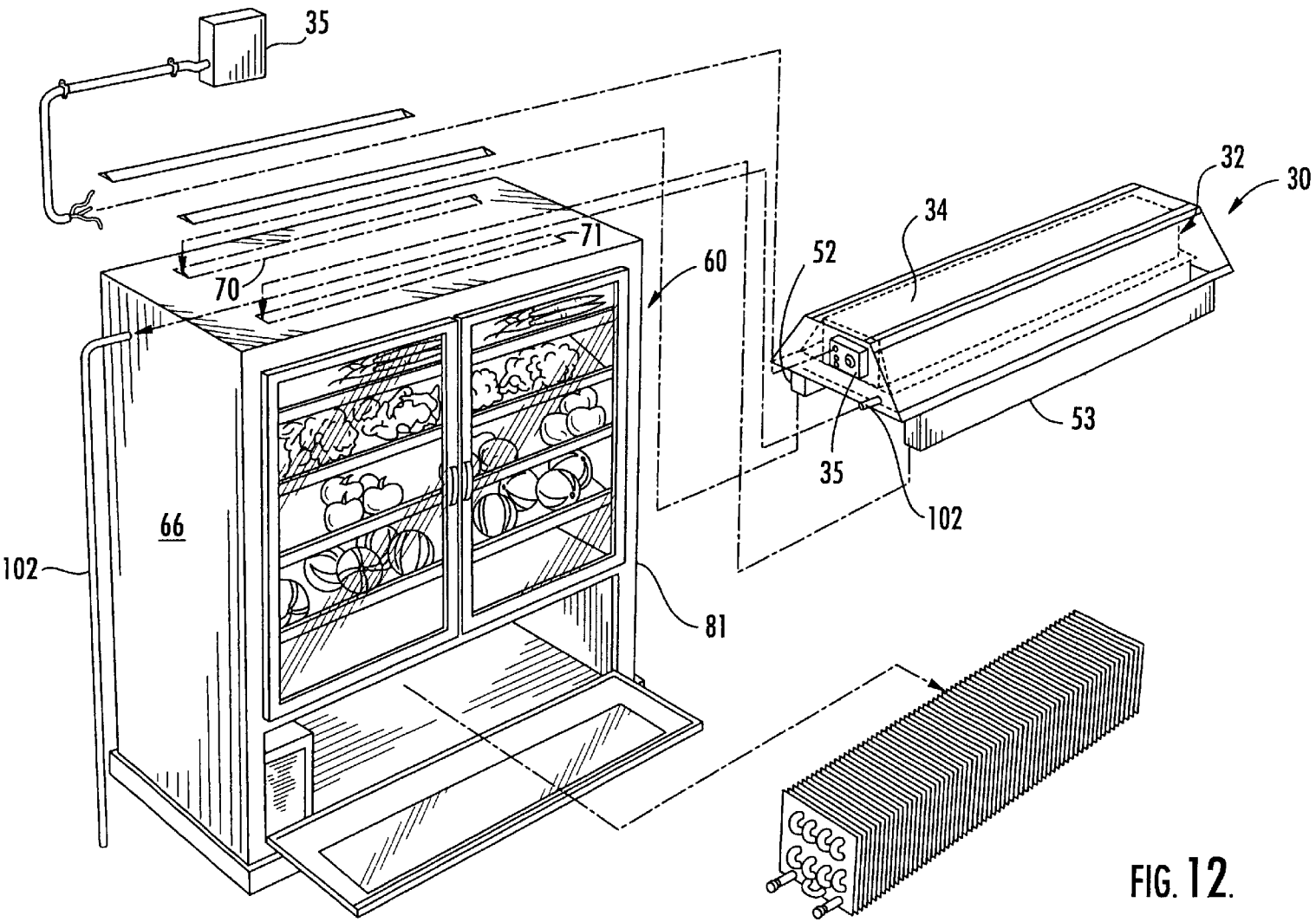
FIG. 12 is an exploded perspective view of an evaporator being removed from an interior portion of a refrigeration apparatus and an evaporator being connected exterior to the refrigeration container according to still another embodiment of the present invention.
Figure 13:
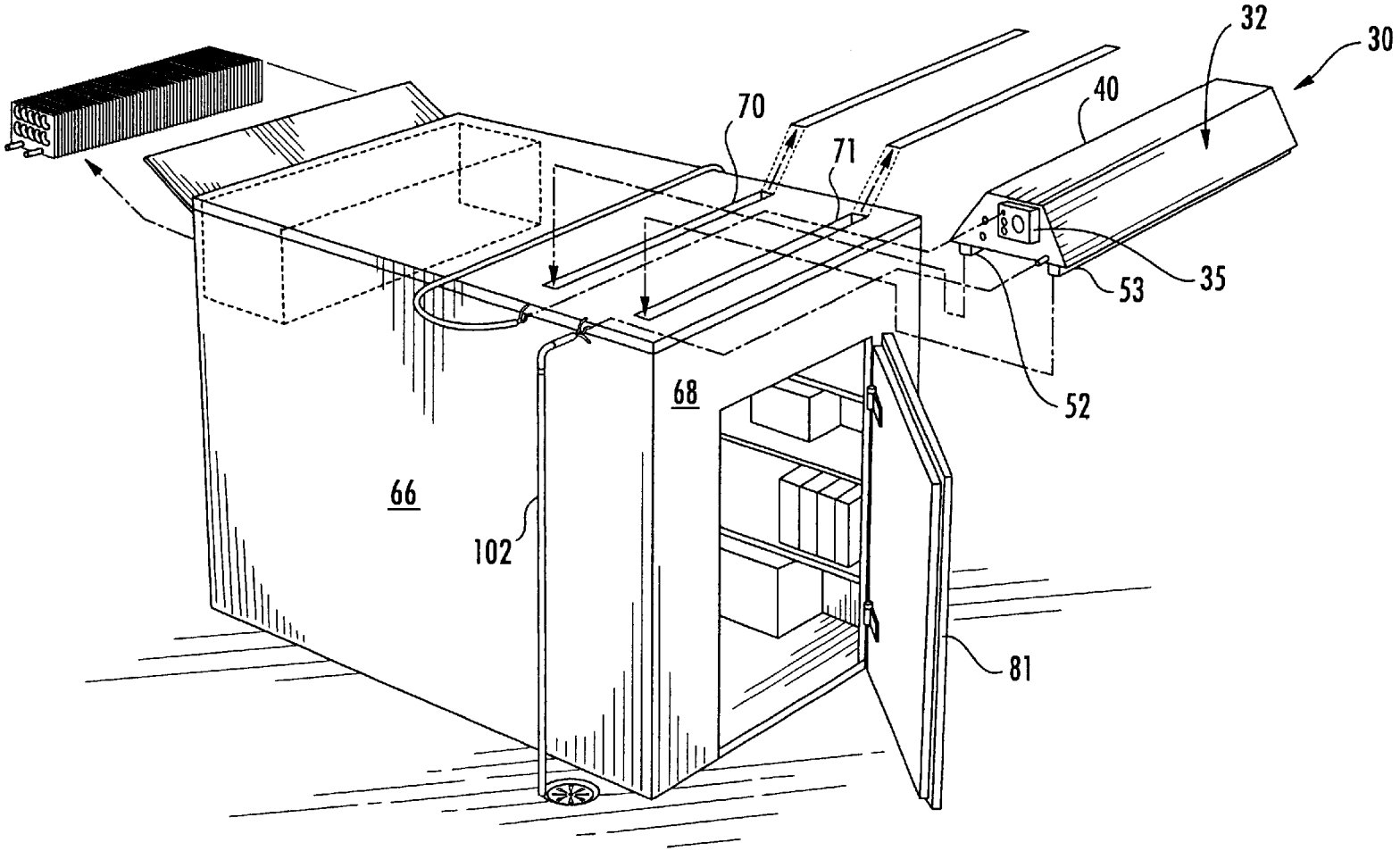
FIG. 13 is an exploded perspective view of an evaporator being removed from a walk-in refrigerator and an evaporator being positioned exterior a walk-in refrigeration container according to yet still another embodiment of the present invention.

As best illustrated in FIGS. 12–13, the present invention further preferably includes a method of converting a refrigeration container 60 having an evaporator 32 positioned within the refrigeration container 60 to a refrigeration container 60 having an evaporator apparatus 30 positioned exterior the refrigeration container 60. The method preferably includes removing the evaporator 32 positioned within the refrigeration container 60, forming a pair of openings in an outer surface of the refrigeration container 70, 71, and installing an evaporator apparatus 30 exterior the refrigeration container 60 to overlie the pair of openings 70, 71 formed in the refrigeration container 60. The method also preferably includes positioning a pair of ducts 52, 53 in the pair of openings formed in the outer surface of the refrigeration container 70, 71.

The step of positioning the evaporator apparatus 30 to overlie the refrigeration container 60 further preferably includes connecting the thermally insulated housing 40 to overlie the pair of ducts 52, 53 positioned in the pair of openings formed in the outer surface of the refrigeration container 70, 71. The step of installing the evaporator apparatus 30 further preferably includes installing a drain pan 100 to underlie the evaporator 32 and overlie a bottom of the thermally insulated housing 41 to collect condensate from the evaporator 32 to prevent the condensate from entering an interior portion of the refrigeration container 60. The method of converting the refrigeration container 60 also preferably includes connecting a drain line 102 to the drain pan 100 to remove the condensate collected in the drain pan 100 and utilizing space in the refrigeration container 60 previously occupied by the evaporator 32 removed from the refrigeration container 60. The step of utilizing the space in the refrigeration container 60 also preferably includes inserting products into the space previously occupied by the evaporator 32 removed from the refrigeration container 60. Alternatively, the step of utilizing the space in the refrigeration container 60 can also include inserting product support shelving into the space previously occupied by the evaporator 32 removed from the refrigeration container 60. The method also preferably includes positioning products onto the product display shelving to be displayed in the refrigeration container 60.

The present invention further preferably includes a method of draining condensate from an evaporator apparatus 30 connected to and overlying a refrigeration container 60 positioned within a grocery store building so that the condensate does not contact interior portions of the refrigeration container 60. The method preferably includes positioning a drain pan 100 to underlie an evaporator 32 positioned within an evaporator apparatus 30 to collect the condensate from the evaporator 32, and extending a drain line 102 from the drain pan 100 to a position spaced-apart from the refrigeration container 60 and exterior to the grocery store building so that the condensate is readily removed from the evaporator apparatus 30 without contacting the interior portions of the refrigeration container 60. The method also preferably includes positioning the drain line 102 to extend along an outer surface of the refrigeration container 60 and into a drain pipe 104 positioned under a floor F of the grocery store building so that the drain pipe 104 positioned under the floor F of the grocery store building provides an exit path for the condensate to exit the grocery store building, and positioning the drain pan 100 at an elevation higher than the drain line 102 so that so that the condensate travels through the drain line 102, into the drain pipe 104 and out of the grocery store building by gravity force. The method further preferably includes positioning the drain pipe 104 at an angle so that the condensate positioned in the drain pipe 104 travels by gravity force.

The present invention also preferably includes a method of reducing energy costs associated with a refrigeration system 20. The method preferably includes connecting an evaporator 32 to a top outer surface of a refrigeration container 60 so that the evaporator overlies the top outer surface of the refrigeration container 60, and forming a cool air curtain 75 by removing warm air from an interior upper portion of the refrigeration container 60 and introducing cool air into the interior upper portion of the refrigeration container 60. The cool air is introduced towards a front interior portion of the refrigeration container 60 and the warm air is extracted from a rear interior portion of the refrigeration container 60 so that the cool air settles towards a bottom interior portion of the refrigeration container 60 after being introduced from the top portion of the refrigeration container 60 and so that the warm air rises towards the interior upper portion of the refrigeration container 60. As perhaps best illustrated in FIGS. 12–13, the method also preferably includes removing an existing evaporator from within the interior portions of the refrigeration container 60.

The step of forming the cool air curtain 75 further preferably includes passing the cool air through a diffuser 54 when the cool air is introduced towards the front interior portion of the refrigeration container 60 so that the cool air is introduced at a substantially higher rater than if the cool air was not passed through the diffuser 54. This advantageously enhances the cool air curtain 75, making the refrigeration system 20, apparatus 25, and evaporator apparatus 30 more energy efficient. The method of reducing energy costs also preferably includes positioning the evaporator 32 connected to the top outer surface of the refrigeration container 60 within a thermally insulated housing 40 so that heat generated by the evaporator does not warm a predetermined area surrounding the refrigeration container 60, positioning a drain pan 100 to underlie the evaporator 32 within the thermally insulated housing 40 to collect condensate from the evaporator 32, and draining the condensate collected in the drain pan 100 by connecting a drain line 102 to the drain pan 100.

The present invention further preferably includes a method of reducing maintenance and installation costs of a refrigeration system 20 positioned in a grocery store building. The method preferably includes connecting an evaporator 32 to an outer surface of a refrigeration container 60 so that maintenance can be performed on the evaporator 32 without accessing interior portions of the refrigeration container 60, and providing ready access to the evaporator 32 so that maintenance can be readily conducted on the evaporator 32. The method also preferably includes removing an existing evaporator 32 from within the interior portions of the refrigeration container 60 and positioning the evaporator 32 connected to the outer surface of the refrigeration container 60 within a thermally insulated housing 40 so that heat generated by the evaporator does not warm a predetermined area surrounding the refrigeration container 60. The method further preferably includes positioning a drain pan 100 to underlie the evaporator within the thermally insulated housing 40 to collect condensate from the evaporator 32 and draining the condensate collected in the drain pan 100 by connecting a drain line 102 to the drain pan 100. The step of providing ready access to the evaporator 32 preferably includes accessing the evaporator 32 positioned within the thermally insulated housing through a door positioned on an outer surface of the thermally insulated housing 40.

The installation costs of a refrigeration system 20 are advantageously reduced because a great deal of manual labor to install the refrigeration system 20 can be eliminated. For example, in a refrigeration system 20 having an evaporator apparatus 30 connected to an exterior portion a refrigeration container 60, the need to exert manual labor to extend several separate drain lines 102 are eliminated as drain lines 102 can be combined. Further, an evaporator apparatus 30, which includes an evaporator 32 positioned within an insulated housing 40, can be preassembled, thereby greatly reducing the amount of labor necessary to install the evaporator apparatus 30. The great reduction in labor can, for example, decrease installation costs of a refrigeration system 20 between 35% and 80%.

The present invention still further includes a method of reducing maintenance costs associated with a drain line 102 to remove condensate from an evaporator 32 of a refrigeration apparatus 25. The method preferably includes positioning a drain pan 100 to underlie an evaporator 32 positioned exterior a refrigeration container 60 to collect the condensate from the evaporator 32, and connecting a drain line 102 to the drain pan 100 positioned exterior the refrigeration container 60 so that the drain line 102 is positioned exterior the refrigeration container 60 and so that the condensate is removed from the drain pan 100 without freezing. The step of connecting the drain line 102 to the drain pan 100 preferably includes extending the drain line 102 to a drain pipe 104 positioned to underlie the floor F of the grocery store building. The step of extending the drain line 102 to the drain pipe 104 preferably includes extending the drain pipe 104 to a position exterior the grocery store building so that the condensate removed from the drain pan 100 is removed to a position exterior the grocery store building. The step of connecting the drain line 102 to the drain pan 100 preferably includes positioning the drain pan 100 at an elevation substantially higher than the elevation of the drain pipe 104 so that the condensate is removed from the drain pan 100 using gravity force.

The present invention also advantageously identifies and solves the problem of cleanliness and sanitation with existing refrigeration containers by removing collected condensate from the refrigeration system before it can be introduced to an interior portion of the refrigeration container. By positioning an evaporator 32 on top of a refrigeration container 60, the difference between discharge air temperature of the cooled air from the evaporator 32 and the ambient inside air temperature of the refrigeration container 60 greatly reduces the accumulation of condensation on exterior surfaces, e.g., bottom, back, or side walls, of the refrigeration container 60, such as a refrigerated display case.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

What is claimed is:

1. A method of reducing energy costs associated with a refrigeration system, the method comprising:

connecting an evaporator to a top outer surface of a refrigeration container so that the evaporator overlies the top outer surface of the refrigeration container; and forming a cool air curtain by removing warm air from an interior upper portion of the refrigeration container and introducing cool air into the interior upper portion of the refrigeration container, the warm air having a substantially lower density than the cool air, the cool air being introduced towards a front interior portion of the refrigeration container and the warm air being extracted from a rear interior portion of the refrigeration container, the cool air settling towards a bottom interior portion of the refrigeration container after being introduced from the top portion of the refrigeration container and the warm air rising towards the interior upper portion of the refrigeration container.

2. A method according to claim 1, further comprising removing an existing evaporator from within the interior portions of the refrigeration container.

3. A method according to claim 2, wherein the step of forming the cool air curtain further comprises passing the cool air through a diffuser when the cool air is introduced towards the front interior portion of the refrigeration container so that the cool air is introduced at a substantially higher rater than if the cool air was not passed through the diffuser.

4. A method according to claim 3, further comprising positioning the evaporator connected to the top outer surface of the refrigeration container within a thermally insulated housing so that heat generated by the evaporator does not warm a predetermined area surrounding the refrigeration container.

5. A method according to claim 4, further comprising positioning a drain pan to underlie the evaporator within the thermally insulated housing to collect condensate from the evaporator.

6. A method according to claim 5, further comprising draining the condensate collected in the drain pan by connecting a drain line to the drain pan.

7. A method according to claim 6, wherein the refrigeration container, evaporator, and thermally insulated housing are positioned to overlie a floor within a grocery store building, and wherein the step of draining the condensate further comprises extending the drain line from the drain pan to a drain pipe positioned to underlie the floor of the grocery store building so that the condensate is removed to a positioned exterior the grocery store building.

8. A method according to claim 7, wherein the elevation of the drain pan is substantially higher than the elevation of the drain pipe positioned under the floor of the grocery store building and wherein the step of draining the condensate further comprises draining the condensate using gravity force.

9. A method according to claim 8, further comprising positioning the drain pipe at an angle and wherein the step of draining the condensate further comprises draining the condensate to a position exterior the grocery store building using gravity force.

* * * * *